United States Patent [19]

Goh

[11] Patent Number: 4,995,848

[45] Date of Patent: Feb. 26, 1991

[54] COIN SORTERS

[75] Inventor: David Goh, Telford, England

[73] Assignee: Scan Coin AB of Jagershillgatan 26, S-213, Malmo, Sweden

[21] Appl. No.: 424,223

[22] PCT Filed: Apr. 8, 1988

[86] PCT No.: PCT/GB88/00274

§ 371 Date: Nov. 17, 1989

§ 102(e) Date: Nov. 17, 1989

[87] PCT Pub. No.: WO88/08174

PCT Pub. Date: Oct. 20, 1988

[30] Foreign Application Priority Data

Apr. 9, 1987 [GB] United Kingdom ..... 8708555

[51] Int. Cl.[5] ..... G07D 3/12

[52] U.S. Cl. ..... 453/3; 453/5; 453/9; 453/15

[58] Field of Search ..... 453/3, 5, 9, 15

[56] References Cited

U.S. PATENT DOCUMENTS

| | | | |
|---|---|---|---|
| 1,271,339 | 7/1918 | McGinnis | 453/9 X |
| 2,764,990 | 10/1956 | Pick | 453/9 X |
| 2,886,045 | 5/1959 | Brown et al. | 453/5 |
| 4,111,215 | 9/1978 | Wicklander | 453/5 |
| 4,396,029 | 8/1983 | Anderson | 453/15 |

FOREIGN PATENT DOCUMENTS

| | | | |
|---|---|---|---|
| 0280238 | 11/1914 | Fed. Rep. of Germany | 453/5 |

*Primary Examiner*—Robert J. Spar
*Assistant Examiner*—William M. Hienz
*Attorney, Agent, or Firm*—Leydig, Voit & Mayer

[57] ABSTRACT

In a coin sorter of the inclined ramp type the inclined ramp has the usual support surface (2) along which the edges of the coins roll, and the usual coin face support surface (3). The support surface (3) is provided both with apertures (6, 7, 8, 9) of progressively increasing size going down the ramp, for coins of the appropriate size to fall through, and with a set of peeler knives (14, 15, 16, 17) at varying distances from the edge support surface (2) for tipping other coins, according to their size, from the ramp. This arrangement facilitates a much shorter ramp, and thereby a more compact machine.

3 Claims, 2 Drawing Sheets

COIN SORTERS

This invention relates to a coin sorter of the kind in which mixed coins pass on edge down an inclined ramp and are subjected to a series of tests which are used to sort the coins.

The term "coin" will be used herein to include a token or bogus coin.

In a common type of such machine the coins roll down the ramp with their rear faces supported by an elongate support surface which is provided with an elongate slot of stepped outline, the slot becoming vertically wider towards the lower end of the ramp. Depending upon the diameter of a coin it will fall through the slot in the support surface at a smaller or greater distance down the ramp. For each portion of the slot of a particular width, a coin collection chute is provided for directing the coins which fall through that portion of the slot to a respective open-topped coin collection box or drawer. Reject coins, which may be detected in various ways are dealt with in a different manner.

When it is required to sort a large number of different coin denominations it is accordingly necessary to provide a corresponding number of coin collection boxes which are arranged in a line beneath the ramp. The long length of the ramp and line of coin boxes leads to a very bulky machine.

In other such machines it is known to provide, instead of a stepped coin slot, a series of longitudinally spaced "peeler knives" which are arranged at different distances from the ramp surface along which the coins roll, and which selectively topple the coins from the ramp at different positions along the ramp in dependence upon coin diameter by engaging with the tops of coins of the appropriate diameters. Again, however, the ramp needs to be long to sort a large number of different coin types.

We have realised that it would be possible and advantageous to provide both peeler knives and slots.

According to the invention we provide a coin sorter of the kind comprising a ramp which is adapted to be inclined in use and to be fed at its upper end with coins of mixed types such that the coins proceed on edge down a coin edge support surface of the ramp, in which the ramp is provided with a coin face support surface for supporting one face of the coins as the coins proceed down the ramp, the coin face support surface being provided with aperture means comprising aperture portions of different widths in the direction normal to the direction of the coin edge support surface, the widths increasing towards the lower end of the ramp whereby some coins, depending on their diameters in relation to the transverse dimensions of the aperture portions, will fall through the corresponding aperture portions, the ramp also comprising a plurality of coin deflecting members spaced apart along the ramp and located at different distances from the coin edge support surface, the distances decreasing in the direction from the upper end of the ramp to the lower end of the ramp, the coin deflecting members being so arranged that some coins, in dependence on their diameter, engage with the corresponding deflecting member and are deflected away from the coin face support surface to fall from the ramp.

Since the coin sorter uses both the mechanism of allowing coins to fall backwards through appropriate portions of an aperture and the mechanism of deflecting coins forwardly off the ramp by suitably positioned deflecting members, it is possible to shorten the ramp considerably.

The invention also facilitates a much more compact layout of the coin collection boxes. Essentially, the chutes into which the coins fall may be arranged in an array of two rows rather than in a single line as with the known sorters of this type.

In a preferred arrangement of the coin collection boxes, an upper line of boxes is arranged such that the fronts of the boxes are arranged in line above the fronts of the boxes in a lower line of boxes, the boxes of the lower line being of greater depth than those of the upper line of boxes, in the horizontal direction normal to the box fronts, whereby the lower boxes collect the coins which have fallen through the aperture means, and the upper boxes collect the coins which have been displaced from the ramp by the deflecting members, or vice versa if desired.

Each box in the lower line is preferably arranged directly below a box in the upper line, but if desired they could be staggered. As usual the boxes are preferably removable by sliding them for cards.

The ramp is preferably fed with coins by a hopper type of coin feeder. That is, a coin feeder of the type comprising an inclined disc with pockets around its periphery for picking out coins one by one from a batch of coins inserted into the hopper.

It will, of course, be necessary to arrange the coin deflecting members in the correct order in relation to the transverse dimensions of the aperture portions.

The aperture portions could be independent apertures but are preferably portions of a single slot defined by a stepped upper edge.

A coin sorter in accordance with the invention will now be described, by way of example only, with reference to the accompanying schematic drawings in which.

Figure 1:
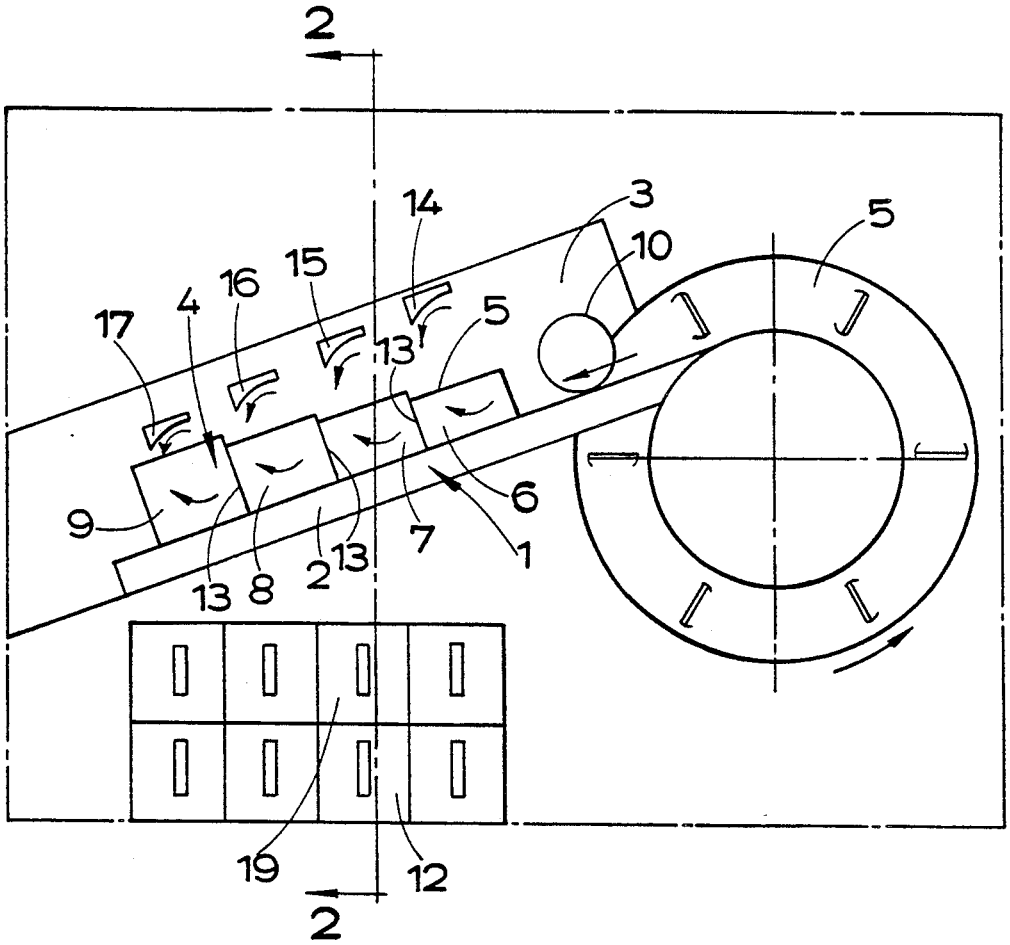
FIG. 1 is a front elevation of the machine.

In the drawings a coin ramp 1 comprises a coin edge support member 2 and a coin face support plate 3, and the upper end of the ramp is arranged to be fed with coins by a rotatable coin feeding disc 5 which is inclined to the vertical, conveniently at the same angle to the vertical as the plate 3. The disc 5 dips into a hopper or trough into which coins are put for sorting, and in known manner the coins are picked out of the batch of coins and fed to the upper end of ramp 1 for rolling in single file down the ramp 1 with the edge of the coin 10 supported on member 2 and with its rear face supported on plate 3.

Figure 2:
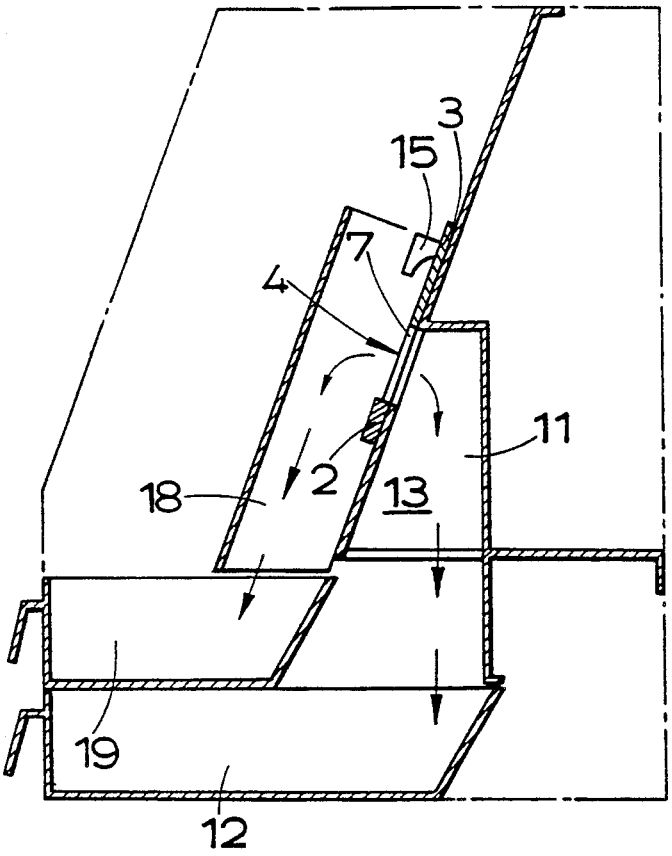
FIG. 2 is a section on the line 2—2 of FIG. 1.

Plate 3 is provided with a longitudinally extending slot 4 defined at its lower edge by the support member 2 and by a multi-stepped upper edge 5 shaped so as to define four (in this example) rectangular slot portions 6, 7, 8 and 9 of heights, measured in the direction normal to the coin edge support surface of member 2, which increase down the ramp. The heights of the slot portions 6, 7, 8 and 9 are chosen such that selected coins will be sorted according to their diameters by falling through the appropriate slot portion. As shown in FIG. 2 the coins which fall through one of the slot portions, portion 7 in FIG. 2, passes down a respective vertical chute 11 to fall into the rear end of one of the lower coin collection trays or boxes, box 12 in this case. The coin chutes 11 are separated from one another by partition walls 13, three in the example shown, which are positioned at the junction between adjacent portions of the slot 4.

Figure 3:
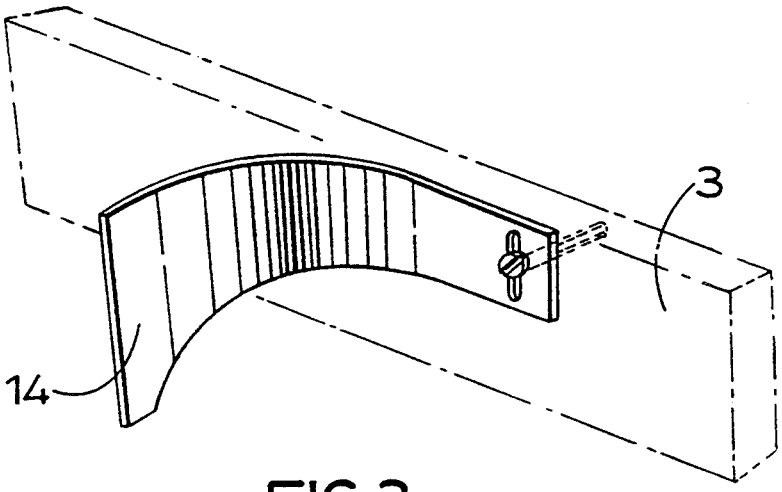
FIG. 3 is an enlarged perspective view of a peeler knife.

Peeler knives 14, 15, 16 and 17 of conventional curved shape, shown in FIG. 3, are mounted as shown on the front of plate 3 at progressively decreasing distances from the member 2 going down the ramp.

In the illustrated example there are four peeler knives 14 to 17, but it will be appreciated that the number of peeler knives does not have to be the same as the number of slot portions 6 to 9.

The four peeler knives 14 to 17 are conveniently positioned each above a respective slot portion 6 to 9 to facilitate the neat, compact assembly of coin boxes shown in which there are two rows of four coin boxes. The peeler knives are arranged in known manner to deflect selected coins from the plate 3 such that they topple forwards from the ramp and fall down an inclined chute, such as the chute 18 of FIG. 2, to drop into the respective upper coin collection box 19.

I claim:

1. A coin sorter comprising a ramp (1) which is adapted to be inclined in use and to be fed at its upper end with coins (10) of mixed types such that the coins proceed on edge down a coin edge support surface (2) of the ramp, in which the ramp is provided with a coin face support surface (3) for supporting one face of the coins as the coins proceed down the ramp, the coin face support surface being provided with aperture means comprising aperture portions (6, 7, 8, 9) of different widths in the direction normal to the direction of the coin edge support surface, the widths increasing towards the lower end of the ramp whereby some coins, depending on their diameters in relation to the transverse dimensions of the aperture portions, will fall through corresponding aperture portions, characterised in that the ramp (1) also comprises a plurality of coin deflecting members (14, 15, 16, 17) spaced apart along the ramp and located at different distances from the coin edge support surface (2), the distances decreasing in the direction from the upper end of the ramp to the lower end of the ramp, the coin deflecting members being so arranged that some coins, in dependence on their diameter, engage with a corresponding deflecting member and are deflected away from the coin face support surface to fall from the ramp.

2. A coin sorter as claimed in claim 1 characterised in that an upper line of coin collection boxes (19) is arranged such that the fronts of the boxes are arranged in line above the fronts of boxes (12) in a lower line of coin collection boxes, the boxes of the lower line being of greater depth than those of the upper line of boxes, in the horizontal direction normal to the box fronts, whereby the lower boxes collect the coins which have fallen through the aperture means, and the upper boxes collect the coins which have been displaced from the ramp by the deflecting members, or vice versa.

3. A coin sorter as claimed in claim 2 characterised in that each box in the lower line is arranged directly below a box in the upper line.

* * * * *